US006360065B1

(12) United States Patent
Ishibashi et al.

(10) Patent No.: US 6,360,065 B1
(45) Date of Patent: Mar. 19, 2002

(54) METHOD AND APPARATUS FOR IMAGE FORMING CAPABLE OF EFFECTIVELY GENERATING A CONSISTENT CHARGE POTENTIAL

(75) Inventors: Hitoshi Ishibashi, Tokyo; Masumi Satou; Megumi Ohtoshi, both of Kanagawa-ken, all of (JP)

(73) Assignee: Ricoh Co., Ltd., Tokyo (JP)

( * ) Notice: Subject to any disclaimer, the term of this patent is extended or adjusted under 35 U.S.C. 154(b) by 0 days.

(21) Appl. No.: 09/631,345

(22) Filed: Aug. 2, 2000

(30) Foreign Application Priority Data

Aug. 2, 1999 (JP) ..... 11-218878
Aug. 2, 1999 (JP) ..... 11-218885

(51) Int. Cl.[7] ..... G03G 15/02
(52) U.S. Cl. ..... 399/174; 361/225
(58) Field of Search ..... 399/174, 175, 399/176, 168, 50; 361/221, 225; 430/902

(56) References Cited

U.S. PATENT DOCUMENTS

| | | | | |
|---|---|---|---|---|
| 3,935,517 A | | 1/1976 | O'Brien | 361/229 |
| 5,146,280 A | * | 9/1992 | Kisu | 399/176 |
| 5,420,671 A | * | 5/1995 | Kisu et al. | 399/174 |
| 5,475,471 A | | 12/1995 | Kisu et al. | 399/115 |
| 5,666,606 A | * | 9/1997 | Okano et al. | 399/174 |
| 5,799,229 A | | 8/1998 | Yokoyama et al. | 399/100 |
| 5,946,529 A | | 8/1999 | Sato et al. | 399/100 |
| 6,014,529 A | * | 1/2000 | Sato | 399/50 |
| 6,088,551 A | | 7/2000 | Satoh et al. | 399/100 |

FOREIGN PATENT DOCUMENTS

| | | |
|---|---|---|
| EP | 0 272 072 | 6/1988 |
| EP | 0 338 546 | 10/1989 |
| EP | 0 443 800 | 8/1991 |
| EP | 0 458 273 | 11/1991 |
| EP | 0 496 399 | 7/1992 |
| JP | 6-242660 | 9/1994 |
| JP | 8-022167 | 1/1996 |
| JP | 8-202126 | 8/1996 |
| JP | 8-314236 | 11/1996 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A charging apparatus includes a charging member arranged to be adjacent to a photoconductive member with a gap having a tolerance in a charging region relative to the photoconductive member and applied with a voltage including a direct current voltage under a constant voltage control including an alternating current element to apply a charge to the photoconductive member. The alternating current element has a peak-to-peak voltage at least twice as great as a charge-start voltage to be applied to the charging member at a maximum gap within a range of the gap having the tolerance.

88 Claims, 6 Drawing Sheets

Fig. 8A

TABLE 1

| GAP | TYPE OF THE APPLIED VOLTAGE | | |
|---|---|---|---|
| | A | B | C |
| 0 | ○ | ○ | ○ |
| 53 μm | × | ○ | ○ |
| 87 μm | × | ○ | ○ |
| 106 μm | × | × | × |

Fig. 8B

TABLE 2 [VOLT]

| | DC BIAS | AC BIAS | | | | | | | |
|---|---|---|---|---|---|---|---|---|---|
| | | 1200 | 1400 | 1600 | 1800 | 2000 | 2200 | 2400 | 2600 |
| I (L:53 μm, R:0 μm) | −400 | − | − | ○ | ○ | ○ | ○ | ○ | |
| | −600 | × | △ | ○ | ○ | ○ | ○ | ○ | |
| | −800 | × | △ | ○ | ○ | ○ | ○ | ○ | |
| II (L:87 μm, R:0 μm) | −400 | − | − | △ | △ | ○ | ○ | ○ | ○ |
| | −600 | − | − | △ | △ | ○ | ○ | ○ | ○ |
| | −800 | − | − | △ | △ | ○ | ○ | ○ | ○ |
| III (L:106 μm, R:0 μm) | −400 | − | − | △ | △ | △ | △ | △ | △ |
| | −600 | − | − | △ | △ | △ | △ | △ | △ |
| | −800 | − | − | △ | △ | △ | △ | △ | △ |

Fig. 8C

TABLE 3

| GAP DEVIATION | TYPE OF THE APPLIED VOLTAGE | | | | | | | | |
|---|---|---|---|---|---|---|---|---|---|
| | A | | | B | | | C | | |
| | L | C | R | L | C | R | L | C | R |
| I | ○ | ○ | ○ | ○ | ○ | ○ | ○ | ○ | ○ |
| II (L: 53 μm, R: 0 μm) | × | × | ○ | ○ | ○ | ○ | ○ | ○ | ○ |
| III (L: 87 μm, R: 0 μm) | × | × | ○ | ○ | ○ | ○ | ○ | ○ | ○ |
| IV (L: 100 μm, R: 0 μm) | × | × | ○ | ○ | ○ | ○ | ○ | ○ | ○ |
| V (L: 106 μm, R: 53 μm) | × | × | △ | △ | ○ | ○ | △ | ○ | ○ |

Fig. 8D

TABLE 4

| | GAP DEVIATION (μm) | | | | | |
|---|---|---|---|---|---|---|
| | 10 | 20 | 53 | 87 | 100 | 106 |
| A | ○ | × | × | × | × | × |
| B | ○ | ○ | ○ | ○ | ○ | △ |
| C | ○ | ○ | ○ | ○ | ○ | △ |

METHOD AND APPARATUS FOR IMAGE FORMING CAPABLE OF EFFECTIVELY GENERATING A CONSISTENT CHARGE POTENTIAL

CROSS-REFERENCE TO RELATED APPLICATIONS

This application claims priority to Japanese patent application Nos. JPAP11-218878 filed on Aug. 2, 1999 and JPAP 11-218885 filed on Aug. 2, 1999 in the Japanese Patent Office, the entire contents of which are hereby incorporated by reference.

BACKGROUND OF THE INVENTION

1. Field of the Invention:

The present invention relates to a method and apparatus for image forming, and more particularly to a method and apparatus for image forming that is capable of effectively generating a consistent charge potential.

2. Description of the Background:

Charging the surface of a photoconductive member is one of basic and important processes performed in an image forming apparatus using an electrophotographic method, such as a copying machine, a facsimile machine, a printer, and so forth. There have been developed various techniques for consistently charging the surface of the photoconductive member, which are classified in two types. In a first type, which is referred to as a contact type charging technique, a charging member is configured to make its surface contact the photoconductive member so as to provide charges evenly to the surface of the photoconductive member. In a second type, which is referred to as a non-contact type charging technique, a charging member is configured to be closely adjacent to the photoconductive member so as to provide a small gap between the charging member and the photoconductive member.

The non-contact type charging has an advantage in the performance of a charging operation, particularly in evenly charging the surface of the photoconductive member. However, the non-contact type charging has a drawback of a production of ozone. Therefore, the contact type is now becoming a mainstream.

However, the contact type charging also has several drawbacks due to its mechanism which causes the charging member such as a charging roller to directly contact the surface of the photoconductive member. For example, the photoconductive member will be contaminated due to the contact with the charging roller so that an abnormal image will be produced. The photoconductive member may develop a crack at a place on the surface contacting the charging roller if an excess contact pressure is applied onto the surface of the photoconductive member.

Further, the charging roller itself may be contaminated by the toner deposited on the photoconductive member. If the limit of the contamination is violated, the charging roller reduces the charge performance, particularly the consistency of the charge.

Further, the surface of the photoconductive member may be worn by the contact of the charging roller and the charge potential is reduced.

In addition, if the photoconductive member has a pinhole, it has not a sufficient margin against a leakage of the charge through the pinhole.

In order to avoid these problems, the charging roller is arranged to merely have an extreme small gap relative to the photoconductive member and to charge the photoconductive member from that distance. However, if the charging roller is made of an elastic material, it is difficult to make such a gap in an accurate cost-effective manner.

SUMMARY OF THE INVENTION

Accordingly, the present invention provides a novel charging apparatus in view of the above discussion.

In one example, a novel charging apparatus includes a charging member which is arranged to be adjacent to a photoconductive member with a gap having a tolerance in a charging region relative to the photoconductive member and is applied with a voltage including a direct current voltage under a constant voltage control including an alternating current element to apply a charge to the photoconductive member. The above-mentioned alternating current element has a peak-to-peak voltage at least twice as great as a charge-start voltage to be applied to the charging member at a maximum gap within a range of the gap having the tolerance.

The charging member may be a rotatable elastic roller.

The photoconductive member may be a rotatable photoconductive drum or belt.

The tolerance of the gap may be caused by an inaccurate flatness of a surface of the charging member.

The tolerance of the gap may be caused by inaccuracy of parallel alignment of the charging member and the photoconductive member.

The maximum gap may be greater than a maximum gap requiring a charge-start voltage greater than the charge-start voltage required in a case when the gap is substantially 0.

The charging member may be arranged to be adjacent to and partly contact the photoconductive member so as to partly form the gap having the tolerance.

The present invention further provides a novel charging method. In one example, the novel charging method includes the steps of providing, superposing, and applying. The providing step provides a charging member to form a gap having a tolerance in a charging region relative to a photoconductive member. The superposing step superposes an alternating current element to a direct current voltage under a constant voltage control. In this case, the alternating current element has a peak-to-peak voltage at least twice as great as a charge-start voltage to be applied to the charging member at a maximum gap within a range of the gap having the tolerance. The applying step applies the direct current voltage with the superposed alternating current element to the charging member to apply a charge to the photoconductive member.

Further, the present invention provides an image forming apparatus. In one example, a novel image forming apparatus includes a photoconductive member and a charging apparatus. The charging apparatus charges the photoconductive member and includes a charging member arranged to be adjacent to the photoconductive member to form a gap having a tolerance in a charging region relative to the photoconductive member. The charging member is applied with a direct current voltage under a constant voltage control including an alternating current element to apply a charge to the photoconductive member. In this case, the alternating current element has a peak-to-peak voltage at least twice as great as a charge-start voltage to be applied to the charging member at a maximum gap within a range of the gap having the tolerance.

Further, the present invention provides a charging apparatus. In one example, a novel charging apparatus includes a charging member which is arranged to be adjacent to a photoconductive member with a gap having a tolerance in a charging region relative to the photoconductive member and is applied with a voltage including a direct current voltage under a constant voltage control including an alternating current element under a constant current control to apply a charge to the photoconductive member. In this case, the alternating current element has a peak-to-peak voltage at least twice as great as a charge-start voltage to be applied to the charging member at a maximum gap within a range of the gap having the tolerance.

The charging member may be a rotatable elastic roller.

The photoconductive member may be a rotatable photoconductive drum or belt.

The tolerance of the gap may be caused by an inaccurate flatness of a surface of the charging member.

The tolerance of the gap may be caused by inaccuracy of parallel alignment alignment of the charging member and the photoconductive member.

The maximum gap may be greater than a maximum gap requiring a charge-start voltage greater than the charge-start voltage required in a case when the gap is substantially 0.

The charging member may be arranged to be adjacent to and partly contact the photoconductive member so as to partly form the gap having the tolerance.

Further, the present invention provides a charging method. In one example, a novel charging method includes the steps of providing, superposing, and applying. The providing step provides a charging member to form a gap having a tolerance in a charging region relative to a photoconductive member. The superposing step superposes an alternating current element under a constant current control to a direct current voltage under a constant voltage control. In this case, the alternating current element has a peak-to-peak voltage at least twice as great as a charge-start voltage to be applied to the charging member at a maximum gap within a range of the gap having the tolerance. The applying step applies the direct current voltage with the superposed alternating current element to the charging member to apply a charge to the photoconductive member.

Further, the present invention provides a novel image forming apparatus. In one example, a novel image forming apparatus includes a photoconductive member and a charging apparatus. The charging apparatus charges the photoconductive member and includes a charging member arranged to be adjacent to the photoconductive member to form a gap having a tolerance in a charging region relative to the photoconductive member. The charging member is applied with a direct current voltage under a constant voltage control including an alternating current element under a constant current control to apply a charge to the photoconductive member. In this case, the alternating current element has a peak-topeak voltage at least twice as great as a charge-start voltage to be applied to the charging member at a maximum gap within a range of the gap having the tolerance.

Further, the present invention provides a charging apparatus. In one example, a novel charging apparatus includes a charging member which is arranged to be adjacent to a photoconductive member to form a gap having a tolerance in a charging region relative to the photoconductive member and is applied with a direct current voltage under a constant voltage control including an alternating current element to apply a charge to the photoconductive member. In this case, the gap has a mean value at each position in the charging region in longitudinal and circumference directions of the charging member is greater than 10 $\mu$m and of which deviation is greater than 10 $\mu$m relative to the mean value. Further, the alternating current element has a peak-to-peak voltage at least twice as great as a charge-start voltage to be applied to the charging member at a maximum gap within a range of the gap having the tolerance.

The charging member may be a rotatable elastic roller.

The photoconductive member may be a rotatable photoconductive drum or belt.

The gap may be formed with an intermediate member to be placed between the charging member and the photoconductive member and a thickness of the intermediate member determines the maximum gap.

The charging member may be arranged to be adjacent to and partly contact the photoconductive member so as to partly form the gap having the tolerance.

Further, the present invention provides a novel charging method. In one example, a novel charging method includes the step of providing and applying. The providing step provides a charging member to form a gap having a tolerance in a charging region relative to the photoconductive member. In this case, the gap has a mean value at each position in the charging region in longitudinal and circumference directions of the charging member is greater than 10 $\mu$m and a deviation of the predetermined gap relative to the mean value is greater than 10 $\mu$m. The applying step applies to the charging member a direct current voltage under a constant voltage control including an alternating current element to charge the photoconductive member. In this case, the alternating current element has a peak-to-peak voltage at least twice as great as a charge-start voltage to be applied to the charging member at a maximum gap within a range of the gap having the tolerance.

Further, the present invention provides a novel image forming apparatus. In one example, a novel image forming apparatus includes a photoconductive member and a charging apparatus for charging the photoconductive member. The charging apparatus includes a charging member which is arranged to be adjacent to the photoconductive member to form a gap having a tolerance in a charging region relative to the photoconductive member and is applied with a direct current voltage under a constant voltage control and an alternating current element to apply a charge to the photoconductive member. In this case, the gap has a mean value at each position in the charging region in longitudinal and circumference directions of the charging member is greater than 10 $\mu$m and of which deviation is greater than 10 $\mu$m relative to the mean value. Further, the alternating current element has a peak-to-peak voltage at least twice as great as a charge-start voltage to be applied to the charging member at a maximum gap within a range of the gap having the tolerance.

Further, the present invention provides a charging apparatus. In one example, a novel charging apparatus includes a charging member which is arranged to be adjacent to a photoconductive member to form a gap having a tolerance in a charging region relative to the photoconductive member and is applied with a direct current voltage under a constant voltage control including an alternating current element under a constant current control to apply a charge to the photoconductive member. In this case, the gap has a mean value at each position in the charging region in longitudinal and circumference directions of the charging member is greater than 10 $\mu$m and of which deviation is greater than 10 $\mu$m relative to the mean value.

The charging member may be a rotatable elastic roller.

The photoconductive member may be a rotatable photoconductive drum or belt.

The charging member may have a volume resistance ratio of 105 Ωm or more.

The charging member may be arranged to be adjacent to and partly contact the photoconductive member so as to partly form the gap having the tolerance.

Further, the present invention provides a novel charging method. In one example, a novel charging method includes the steps of providing and applying. The providing step provides a charging member to form a gap having a tolerance in a charging region relative to the photoconductive member. In this case, the gap has a mean value at each position in the charging region in longitudinal and circumference directions of the charging member is greater than 10 μm and a deviation of the predetermined gap relative to the mean value is greater than 10 μm. The applying step applies to the charging member a direct current voltage under a constant voltage control including an alternating current element under a constant current control to apply a charge to the photoconductive member. In this case, the alternating current element has a peak-to-peak voltage at least twice as great as a charge-start voltage to be applied to the charging member at a maximum gap within a range of the gap having the tolerance.

Further, the present invention provides a novel image forming apparatus. In one example, a novel image forming apparatus includes a photoconductive member and a charging apparatus. The charging apparatus charges the photoconductive member and includes a charging member which is arranged to be adjacent to the photoconductive member to form a gap having a tolerance in a charging region relative to the photoconductive member and is applied with a direct current voltage under a constant voltage control and an alternating current element under a constant current control to apply a charge to the photoconductive member. In this case, the gap has a mean value at each position in the charging region in longitudinal and circumference directions of the charging member is greater than 10 μm and of which deviation is greater than 10 μm relative to the mean value.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein:

FIGS. 8A—8D are tables showing results of experiments with respect to the charging operation performed by the image forming mechanism of FIG. 1.

DETAILED DESCRIPTION OF THE PREFERRED EMBODIMENTS

Figure 1:
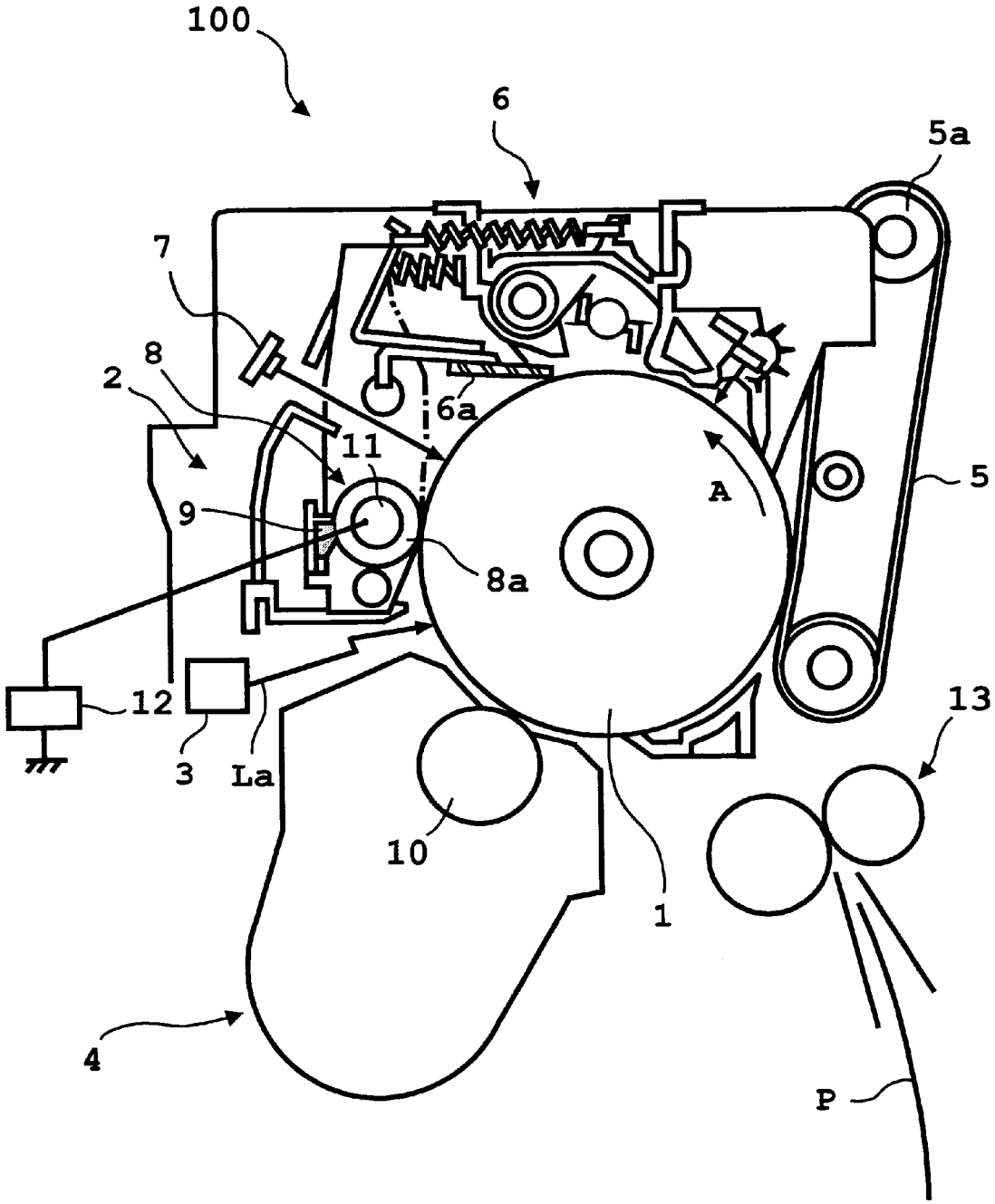
FIG. 1 is an illustration for showing an exemplary image forming mechanism according to an embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, particularly to FIG. 1, there is illustrated an image forming mechanism 100 according to an embodiment of the present invention. The image forming mechanism 100 of FIG. 1 is used in an image forming apparatus, e.g., a copying machine, a facsimile machine, a printer, etc.

The image forming mechanism 100 includes a photoconductive drum 1 that rotates in the direction indicated by the arrow A and a surface of which is evenly charged. The image forming mechanism 100 further includes a main charging unit 2, a light emitting unit 3, a development unit 4, a transfer belt 5, a cleaning unit 6, and a quenching lamp 7, which are arranged around the periphery of the photoconductive drum 1.

The main charging unit 2 charges the surface of the photoconductive drum 1 and includes a charging roller 8, and a roller cleaning member 9. The charging roller 8 is arranged close to the photoconductive drum 1 so as to form a predetermined gap within a charging region relative to the photoconductive drum 1. The roller cleaning member 9 is made of, for example, rubber foam and is held in contact with the charging roller 8 so as to clean the surface of the charging roller 8. The charge roller 8 includes a metal core 11 to which a power supply unit 12 supplies DC (direct current) and AC (alternating current) biases both of which are constant-voltage-controlled. The DC and AC biases, however, may be constant-current-controlled. Thus, the main charging unit 2 evenly charges the surface of the photoconductive drum 1.

The photoconductive drum 1 includes an aluminum base tube having multiple coating layers such as a UL (under layer), a CGL (carrier generation layer), and a CTL (carrier transport layer). This photoconductive drum 1 is driven at a constant velocity in the direction of the arrow A by a main motor (not shown).

Figure 2A:
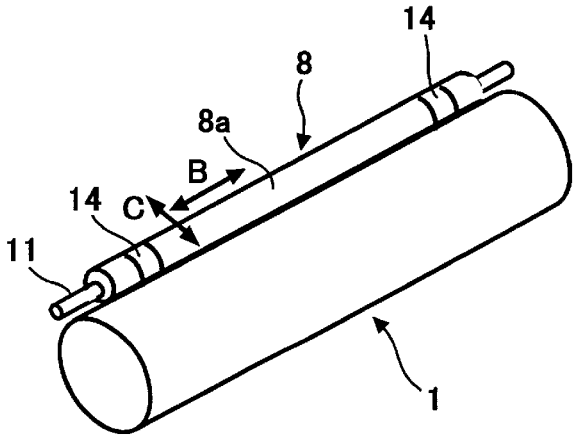
FIG. 2A is an illustration showing a charging roller and a photoconductive drum used in the image forming mechanism of FIG. 1.
Figure 2B:
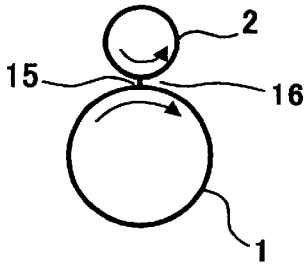
FIG. 2B is an illustration showing a relationship between the charging roller and the photoconductive drum shown in FIG. 2A.

The charging roller 8 is held for rotation on both ends of the metal core 11. The charging roller 8 includes an elastic roller layer 8*a* over the metal core 11. On each side of the elastic roller layer 8*a*, a TEFLON-coated tube 14 is tightly fixed (the generic terminology for TEFLON is polytetrafluoroethylene), as shown in FIG. 2A. As illustrated in FIG. 2B, via the thickness of the TEFLON-coated tube 14, a gap 15 is formed in a development region 16 between the longitudinal surfaces of the elastic roller layer 8*a* and the photoconductive drum 1. Since the charging roller 8 and the photoconductive drum 1 generally have distortions in the flatness of the surface thereof in the longitudinal and circumference directions, indicated by arrows B and C, respectively, in FIG. 2A, the above-mentioned gap 15 (FIG. 2B) varies depending upon the positions thereof in the longitudinal and circumference directions B and C. Amongst the values of the gap 15, a largest value is referred to as a maximum gap. In other words, the thickness of the Teflon tube 14 determines the maximum gap.

In the image forming mechanism 100, the gap 15 has a mean value of 10 μm or more and varies by 10 μm or more relative to the mean value. Using this gap 15, a voltage to be applied for the charging operation is defined based on experimental results, which are explained later. That is, in the image forming mechanism 100, a voltage that includes an alternative current element is applied to the development region 16 formed between the charging roller 8 and the photoconductive drum 1. This voltage has a peak-to-peak value which is two or more times greater than a voltage at which the area of the maximum gap is started to be charged. The above-mentioned alternative current element is controlled at a predetermined constant current value so that the voltage has an AC (alternating current) peak-to-peak value which is two or more times greater than a DC (direct current) voltage at which the area of the maximum gap is started to be charged, as mentioned above. This DC voltage is referred to as a charge-start voltage.

Referring again to FIG. 1, an image forming operation performed by the image forming mechanism 100 will now be explained. When the operation is started, the photoconductive drum 1 is rotated in the direction of the arrow A and the surface of the photoconductive drum 1 is evenly discharged to a reference potential by the quenching lamp 7.

Then, the surface of the photoconductive drum 1 is evenly charged by the charging roller 8. The charged surface is exposed to light La corresponding to image information sent from the light emitting unit 3. Thereby, an electrostatic latent image is formed on the surface of the photoconductive drum 1.

As the photoconductive drum 1 is rotated in the direction of the arrow A, the electrostatic latent image is moved to a position close to the development unit 4 and is supplied with toner by a development sleeve 10, which is included in the development unit 4. Thereby, the latent image is visualized and is formed as a toner image on the photoconductive drum 1.

In parallel, a recording sheet P is transported from a sheet supply unit (not shown) and is held at registration rollers 13, which is included in the image forming mechanism 100. The registration roller 13 then releases the recording sheet P when the leading edge of the recording sheet P is precisely synchronized with the leading edge of the toner image on the photoconductive drum 1. Therefore, the recording sheet P is transported to the transfer belt 5, which then transfers the toner image of the photoconductive drum 1 to the recording sheet P.

When the recording sheet P is further transported by the transfer belt 5 to a driving roller 5*a* of the transfer belt 5, the recording sheet P advances as the surface of the driving roller 5*a* rotates away from the recording sheet P. Thereby, the recording sheet P is separated from the transfer belt 5. After that, the recording sheet P is transported to a fixing unit (not shown) which fixes the toner onto the recording sheet P with heat and pressure. The recording sheet P having the fixed toner image is then ejected to an ejection tray or the like.

As the photoconductive drum 1 continuously rotates, the toner remaining on the surface of the photoconductive drum 1 is collected by a cleaning blade 6*a* of the cleaning unit 6 and is returned to the development unit 4 so as to be reused.

Figure 3:
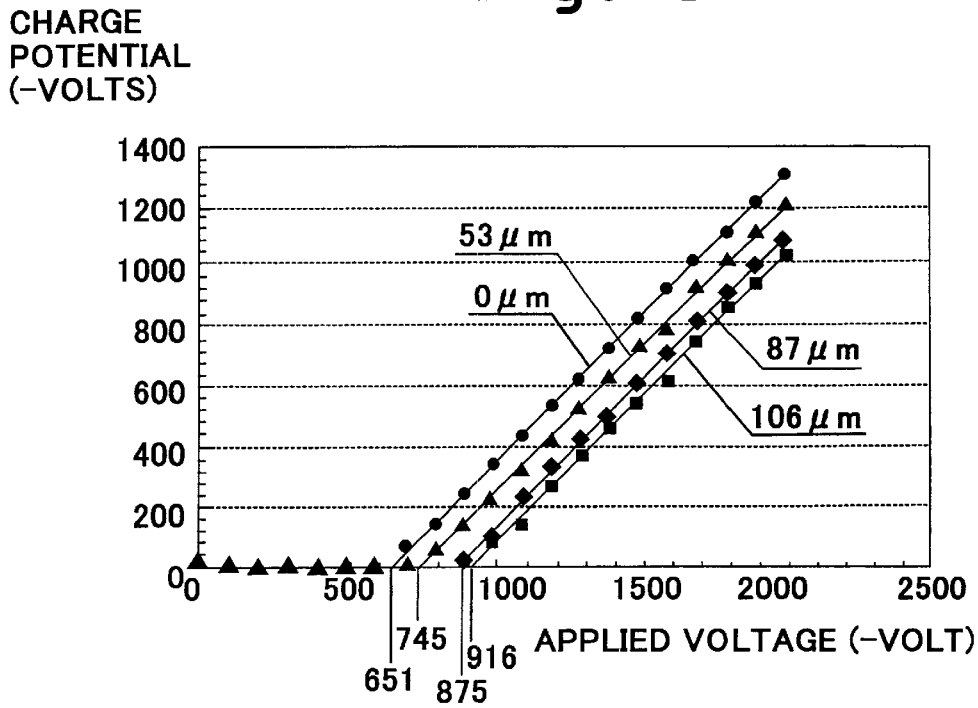
FIG. 3 is a graph for explaining a relationship between a charge potential and a voltage applied to the charging member having different gaps.

Referring now to FIG. 3, a description is made of an exemplary charging performance of the main charging unit 2, or a preferred non-contact type charging unit, which performs the charging operation relative to the gap formed between the charging roller 8 and the photoconductive drum 1. FIG. 3 shows relationships in two experimental cases between an application voltage to be applied to the charging roller 8 and a charging potential to be produced on the surface of the photoconductive drum 1 by the application voltage. In both cases, the photoconductive drum 1 is rotated at a line velocity of 230 mm/s and the charging roller 8 is applied with a DC (direct current) bias having a constant DC voltage. However, in the first experiment, the charging roller 8 is caused to contact the surface of the photoconductive drum 1 so as to perform the contact type charging operation. In the second experiment, the charging roller 8 is caused to form a gap relative to the surface of the photoconductive drum 1 so as to perform the non-contact type charging operation.

The above-described experiments were conducted under the following conditions, unless otherwise specified: (i) the image forming process was operated at a line velocity of 230 mm/s, (ii) the photoconductive drum 1 had a diameter of 60 mm, (iii) the charging roller 8 had a diameter of 16 mm, (iv) the charging roller 8 had a volume resistance of $1\times10^5$ Ωcm or $1\times10^7$ Ωcm, (v) the charge-start voltage in the first experiment was −651 volts, (vi) the charge-start voltage in the second experiment with a gap of 53 μm was −745 volts, (vii) the charge-start voltage in the second experiment with a gap of 87 μm was −875 volts, and (viii) the charge-start voltage in the second experiment with a gap of 106 μm was −916 volts.

As is evident from the charging performances shown in FIG. 3, the photoconductive drum 1 is charged when it is applied with a voltage equal to or greater than a threshold value, or each charge-start voltage (i.e., −651 volts, −745 volts, −875 volts, or −916 volts), but is not charged when it is applied with a voltage smaller than each of the absolute values of the charge-start voltages. When the photoconductive drum 1 is charged with an application of a voltage greater than the charge-start voltage, the potential of the surface of the photoconductive drum 1 will have a linear relationship having a gradient of approximately 1 relative to the applied voltage, regardless of whether or not the charging roller 8 contacts the photoconductive drum 1, as shown in FIG. 3.

Figure 4:
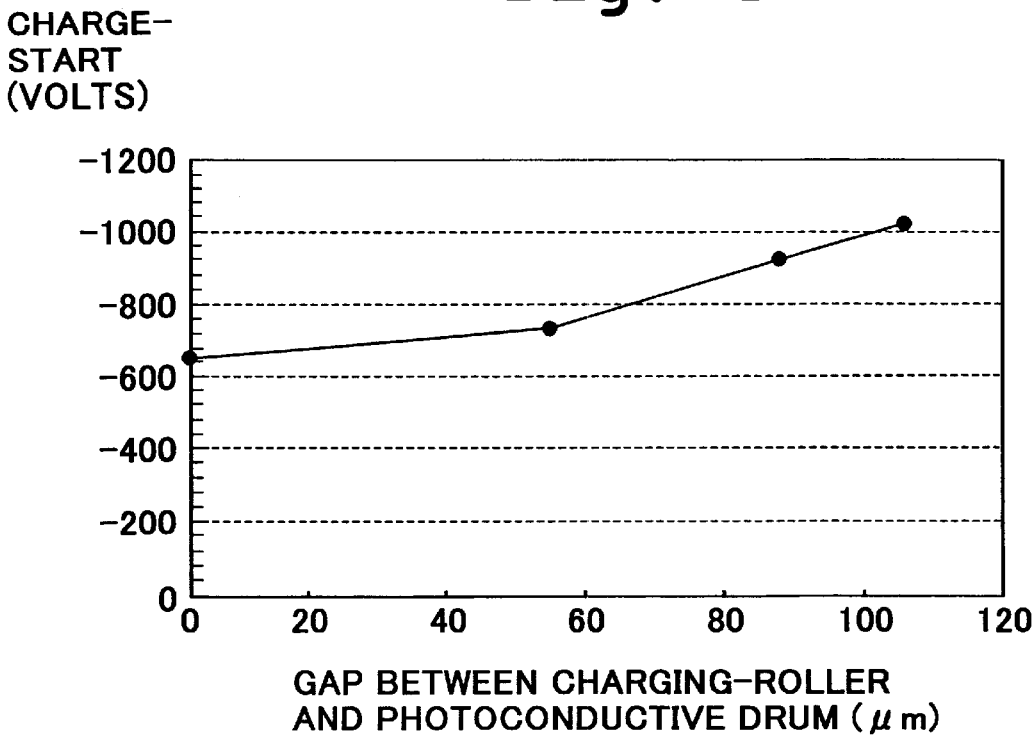
FIG. 4 is a graph for explaining a relationship between a charge-start voltage and the different gaps.

FIG. 4 shows variations of the above-mentioned charge performance when the charging roller 8 is stepwise removed away from the photoconductive drum 1. In this experiment, the charging roller 8 uses the Teflon tubes 14, as illustrated in FIG. 2A, so as to have the gap 15, as illustrated in FIG. 2B, relative to the photoconductive drum 1. That is, the thickness of the Teflon tube 14 is regarded as the maximum gap.

Three kinds of Teflon tubes 14, each having a different thickness (e.g., 53 μm, 87 μm, and 106 μm), were used in this experiment. In each case, the charge performance when the DC-constant-voltage bias was applied to the charging roller 8 was measured. The measurement results are plotted in the graph of FIG. 4 and include the measurement result from the above-described case when the gap 15 is 0, as shown in FIG. 3.

It is understood from this graph that the greater the gap 15 the greater the absolute value of the charge-start voltage with an approximately constant gradient. When the gap 15 is smaller than 53 μm, the variation of the charge-start voltage relative to an increment of the gap 15 is relatively small. However, when the gap 15 is greater than 53 μm, the gap 15 and the charge-start voltage has a linear relationship having a certain gradient.

This observation can also be assumed from the fact that the Paschen's discharge law can be linearly approximated in the case when a gap is greater than 8 μm (i.e., the charge-start voltage=312 volts+6.2×the gap). As for the case of the contact-type method involving the zero-gap, it can also be assumed as correct from the fact that the discharge is actually caused around a region slightly away (i.e., 8 μm or greater) from the nip region of the photoconductive drum 1.

In addition, the charge performance shown in FIG. 3 can lead to an observation in which the charge potential of the photoconductive drum 1 depends on the gap 15 formed between the charge roller 8 and the photoconductive drum 1 under the conditions that a predetermined DC voltage is applied to the charge roller 8. This observation is understood from the Paschen's discharge law.

Figure 5:
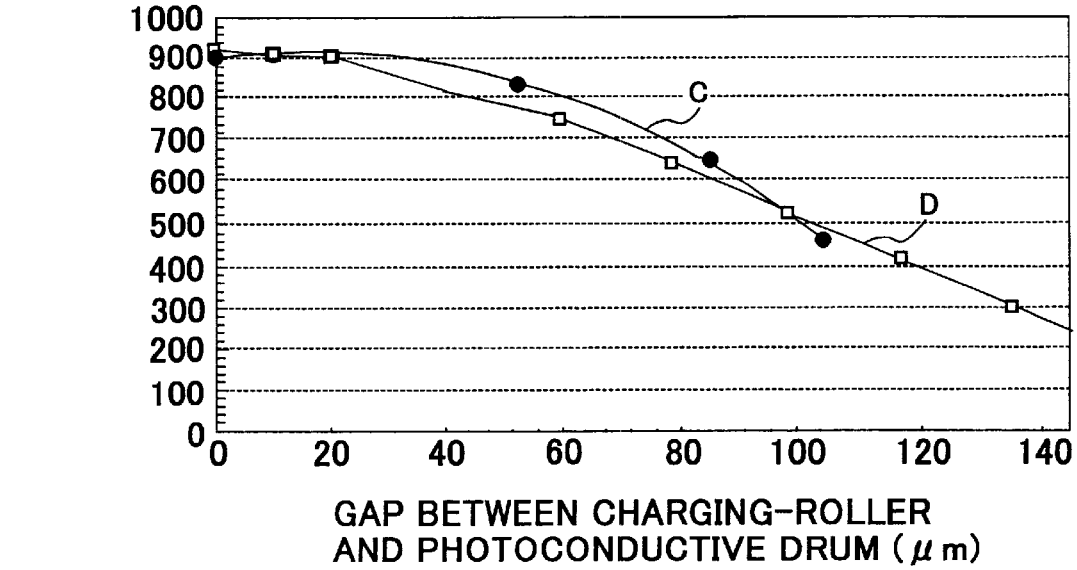
FIG. 5 is a graph for explaining relationships between the charge potential and the different gaps based on a simulation and an experiment.

FIG. 5 shows both simulation and experimental results with respect to the relationship between the gap 15 and the charge performance. In FIG. 5, the simulation result is labeled with a letter C and the experimental result is labeled with a letter D. The graph of FIG. 5 is a case when the DC application voltage, or the DC bias, is fixed to −1600 volts. The results of the simulation and experiment shown in FIG. 5 are similar to each other.

From the graph of FIG. 5, the gap 15 and the charge performance are in the relationship having a variation ratio of approximately 6 volts/μm with the gap 15 greater than 20 μm when the charge roller 8 is applied with the voltage under the constant DC-voltage control.

In an image forming mechanism (i.e., the image forming mechanism 100) employing a charging roller (i.e., the charging roller 8) configured to have a small gap relative to a photoconductive drum (i.e., the photoconductive drum 1), allowable variations of the charge potential are ±30 volts for a mono-color image forming machine and ±10 volts for a multi-color image forming machine. These allowable variations of the charge potential can be converted into variations of the gap 15. For example, the allowable variations of the gap 15 are 10 μm for the mono-color image forming machine and 3.3 μm for the multi-color image forming machine.

Both the charging roller 8 and the photoconductive drum 1 generally have distortions in the flatness of the surfaces thereof, particularly in their longitudinal direction, and in roughness, waves, and so forth. With consideration given to combinations of allowable tolerances for the above-mentioned distortions, typically it may be difficult to achieve the above-mentioned small variations of the gap 15.

Based on this observation, the application voltage that includes the DC bias with an AC (alternating current) superposed thereon is examined.

Figure 6:
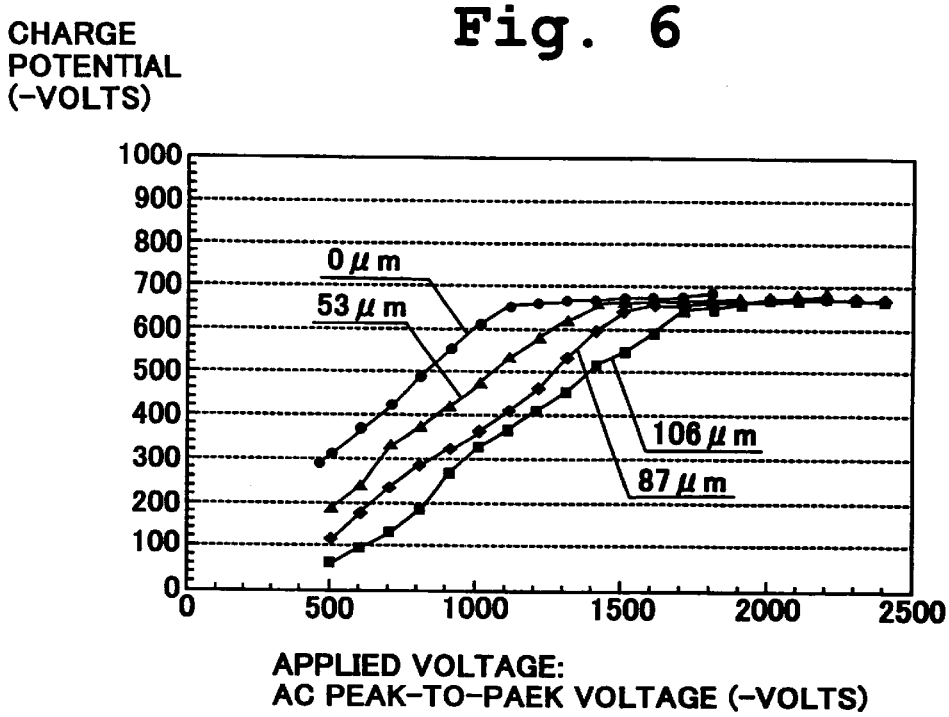
FIG. 6 is a graph for explaining a relationship between the charge potential and the voltage applied to the charging roller having different gaps.

FIG. 6 shows a graph of the charge performance from an experiment performed using the applied voltage that includes a constant DC voltage with an AC constant voltage superposed on the constant DC voltage in the image forming mechanism 100 employing the non-contact type charging roller having a small gap relative to the photoconductive drum 1. From the graph of FIG. 6, it is evident that the photoconductive drum 1 can be charged with the charge potential approximately equal to the applied DC voltage (e.g., −700 volts) by applying the AC peak-to-peak voltage approximately twice as great as the charge-start voltage used during the application of the constant DC voltage (see FIG. 3) to the charging roller 8 in each of the cases where the gap 15 is 0 μm, 53 μm, 87 μm, and 106 μm.

Figure 7:
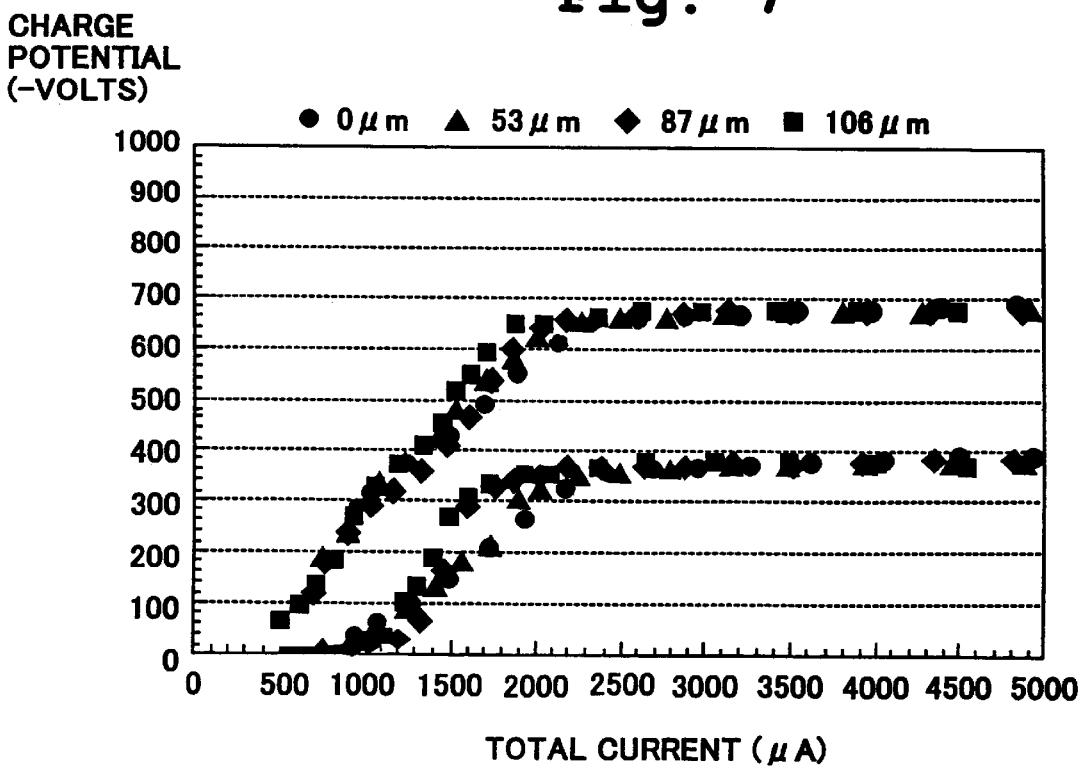
FIG. 7 is a graph for explaining a relationship between the charge potential and a total current passing through an AC bias when the AC bias is controlled at a constant current.

FIG. 7 shows a result of an experimental in which the AC bias to be superposed on the constant DC voltage (i.e., the DC bias) is controlled to feed a constant current. From the graph of FIG. 7, it is evident that the relationship between the total current flowing through the AC bias and the charge potential charged on the surface of the photoconductive drum 1 can be made approximately constant, regardless of the gap 15, by a control of the AC bias superposed on the constant DC voltage to pass a constant current.

Next, results of experiments for outputting a halftone image to observe inconsistency of image density caused by an uneven charging will be explained with reference to FIGS. 8A–8C. FIG. 8A shows Table 1 which represents evaluation results relative to an output halftone image in each of the cases where the gap 15 is 0 μm, 53 μm, 87 μm, and 106 μm, having no gap deviation. In Table 1, a preferable evaluation result is represented by a circle mark and a defective result is represented by a cross mark. Further, in Table 1, the applied voltages A, B, and C represent the applications of the constant DC voltage, the constant DC voltage with the superposed constant AC voltage, and the constant DC voltage with the superposed constant AC current. With the applied voltage B, the AC peak-to-peak voltage is twice or more as large as the charge-start voltage supplied at the maximum gap. With the applied voltage C, the AC bias passes a current which generates a voltage twice or more as large as the charge-start voltage applied at the maximum gap.

According to the experiment shown in Table 1, the output halftone image had defective white spots and was evaluated as a defective image in the cases where the gap 15 was 53 μm or greater with the applied voltage A and in the cases where the gap 15 was 106 μm with the applied voltages B and C. From this, it is understood that superposing the AC bias on the application of the constant DC voltage has a preferable effect in case of the non-contact type charging method.

FIG. 8B shows Table 2 representing evaluation results relative to an output halftone image in each of the different DC biases (i.e., −400 volts, −600 volts, and −800 bolts) with the AC bias varied. In this experiment, the gap 15 was provided with a deviation. The gap deviation of the gap 15 in the case I is such that the maximum gap was 53 μm at the left side and 0 at the right side. In the case II, the maximum gap was 87 μm at the left side and 0 at the right side. In the case III, the maximum gap was 106 μm at the left side and 0 at the right side. In Table 2, a preferable evaluation result is represented by a circle mark, a defective result is represented by a cross mark. In addition, a dash mark represents a case of no judgement and a triangle mark represents a case in which an inconsistent image density was observed but it was allowable.

In the experiment shown in Table 2, the output halftone image was superior when the DC bias was added with the AC bias having the voltage twice or more as great as the charge-start voltage applied at the maximum gap.

Since approximate conditions needed for the preferable bias are understood from these experimental results shown in Tables 1 and 2, the halftone images output under the applied voltage conditions A, B, and C were examined, as shown in Table 3 of FIG. 8C. In this examination, the image was divided into three regions, or left (L), center (C), and right (R) sides corresponding to the left, center, and right longitudinal sides of the charging roller in order to evaluate the effect of the gap deviation on the image. In Table 3, a preferable evaluation result is represented by a circle mark, a defective result is represented by a cross mark. In addition, a triangle mark represents a case in which an inconsistent image density was observed but was allowable.

When the charging roller 8 was applied with the voltage A (the DC bias only), the halftone image was extremely sensitive to the gap deviation and the cases II–V were defective. However, when the charging roller 8 was applied with the voltage B (the constant DC voltage+the constant AC voltage) or C (the constant DC voltage+the constant AC current), no defective images were observed through the cases I–V.

From the simulation result performed before the performance of the experiment, it was recognized that the allowable gap deviation is smaller than 10 $\mu$m. Therefore, the amount of the gap in each cases was precisely measured in the direction of the gap gradient and the relationship between the gap deviation and the inconsistency of the image density was examined based on the measurement results, as shown in Table 4 of FIG. 8D.

From Table 4, it is evident that the limit of the allowable gap deviation with the applied voltage A is about 10 $\mu$m, which approximately proves the simulation result and the gap having the deviation greater than 10 $\mu$m causes the defective image. It is also evident that the halftone images with the applied voltages B and C were examined as having superior image quality, except for the case of the gap deviation of 106 $\mu$m. When the gap deviation was about 106 $\mu$m in both the applied voltages B and C, the white spot phenomenon was observed. However, the appearance level of this phenomenon was almost equal to what it would be in the case of having no gap deviation.

In this way, the main charging unit 2 can avoid the problem of inconsistency of the image density to be caused due to the uneven main charging by applying the constant DC voltage superposed with the AC of which AC element has a peak-to-peak voltage twice or more as great as the charge-start voltage applied to the charging roller 8 at the maximum gap. Also, the main charging unit 2 can avoid the problem of inconsistency of the image density to be caused due to the uneven main charging by applying the constant DC voltage superposed with the AC of which AC element is controlled to have a current for producing a peak-to-peak voltage twice or more as great as the charge-start voltage applied to the charging roller 8 at the maximum gap.

With the above-described configuration of the main charging unit 2, the below mentioned problems occurring in a main charging unit using the contact type main charging can be avoided. That is, the photoconductive drum 1 can be prevented from contamination by toner of the charging roller 8 by the configuration in which the charging roller 8 contacts the photoconductive drum 1. The contact of the charging roller 8 to the photoconductive drum 1 further leads to avoidance of wearing of coating by contact, and so forth. In addition, from the results shown in Table 3, the above-described main charging unit 2 applying the constant DC voltage superposed with the AC can sufficiently be employed in a main charging system having a mixture of the contact and non-contact techniques.

In the above-described experiments where only the DC bias was applied, the DC bias was set to −1300 volts and the development bias was set to −650 volts.

In the experiments where the constant DC voltage with the constant AC voltage was applied, the DC bias was set to −600 volts and the AC bias was set to 2000 volts, which was twice or more as great as the charge-start voltage applied to the charging roller 8 at the maximum gap of 106 $\mu$m.

Further, in the experiments where the constant DC voltage with the constant AC current control was applied, the DC bias was set to −600 volts and the AC bias was set to a current of 2.5 mA, equivalent to a frequency of 2 kHz, for producing an AC peak-to-peak voltage twice or more as great as the charge-start voltage applied to the charging roller 8 at the maximum gap.

In addition, the above-described experiments were successfully conducted using the charging rollers, one having the volume resistance of $1\times10^5$ Ωm and the other having the volume resistance of $1\times10^7$ Ωm, as described above. However, it is assumed from these results that, in a case where the mixture of the contact and non-contact charging methods is applied and the charging roller has the volume resistance smaller than $1\times10^5$ Ωm, the charges would leak through the contact of the charging roller to the photoconductive drum and the main charging operation typically would be defective.

Therefore, the charging roller typically is needed to have the volume resistance greater than $1\times10^5$ Ωm in the case where the mixture of the contact and non-contact charging methods is applied.

Numerous additional modifications and variations of the present application are possible in light of the above teachings. It is therefore to be understood that within the scope of the appended claims, the present application may be practiced otherwise than as specifically described herein.

WHAT IS CLAIMED AS NEW AND IS DESIRED TO BE SECURED BY LETTERS PATENT OF THE UNITED STATES IS:

1. A charging apparatus, comprising:

a charging member arranged to be adjacent to a photoconductive member with a gap having a tolerance in a charging region relative to said photoconductive member, and applied with a voltage including a direct current voltage under a constant voltage control including an alternating current element to apply a charge to said photoconductive member, said alternating current element having a peak-to-peak voltage at least twice as great as a charge-start voltage to be applied to said charging member at a maximum gap within a range of said gap having said tolerance, wherein the maximum gap is greater than a largest gap at which a charge-start voltage substantially equals a charge-start voltage required when said charging member substantially contacts the photoconductive member.

2. The charging apparatus as defined in claim 1, wherein said charging member is a rotatable elastic roller.

3. The charging apparatus as defined in claim 1, wherein said photoconductive member is a rotatable photoconductive drum or belt.

4. The charging apparatus as defined in claim 1, wherein said tolerance of said gap is caused by an inaccurate flatness of a surface of said charging member.

5. The charging apparatus as defined in claim 1, wherein said tolerance of said gap is caused by inaccuracy of parallel alignment of said charging member and said photoconductive member.

6. The charging apparatus as defined in claim 1, wherein said charging member is arranged to be adjacent to and partly contact said photoconductive member so as to partly form said gap having said tolerance.

7. A charging apparatus, comprising:

charging means for charging a photoconductive member, said charging means forming a gap having a tolerance in a charging region relative to said photoconductive member, and applied with a voltage including a direct current voltage under a constant voltage control including an alternating current element to apply a charge to said photoconductive member, said alternating current element having a peak-to-peak voltage at least twice as great as a charge-start voltage to be applied to said charging means at a maximum gap within a range of said gap having said tolerance, wherein the maximum gap is greater than a largest gap at which a charge-start voltage substantially equals a charge-start voltage required when said charging means substantially contacts the photoconductive member.

8. The charging apparatus as defined in claim 7, wherein said charging means is a rotatable elastic roller.

9. The charging apparatus as defined in claim 7, wherein said photoconductive member is a rotatable photoconductive drum or belt.

10. The charging apparatus as defined in claim 7, wherein said tolerance of said gap is caused by an inaccurate flatness of a surface of said charging means.

11. The charging apparatus as defined in claim 7, wherein said tolerance of said gap is caused by inaccuracy of parallel alignment of said charging means and said photoconductive member.

12. The charging apparatus as defined in claim 7, wherein said charging means is arranged to be adjacent to and partly contact said photoconductive member so as to partly form said gap having said tolerance.

13. A charging method, comprising:

providing a charging member to form a gap having a tolerance in a charging region relative to a photoconductive member;

superposing an alternating current element to a direct current voltage under a constant voltage control, said alternating current element having a peak-to-peak voltage at least twice as great as a charge-start voltage to be applied to said charging member at a maximum gap within a range of said gap having said tolerance; and applying said direct current voltage with said superposed alternating current element to said charging member to apply a charge to said photoconductive member, wherein the maximum gap is greater than a largest gap at which a charge-start voltage substantially equals a charge-start voltage required when said charging member substantially contacts the photoconductive member.

14. The method as defined in claim 13, wherein said charging member is a rotatable elastic roller.

15. The method as defined in claim 13, wherein said photoconductive member is a rotatable photoconductive drum or belt.

16. The method as defined in claim 13, wherein said tolerance of said gap is caused by an inaccurate flatness of a surface of said charging member.

17. The method as defined in claim 13, wherein said tolerance of said gap is caused by inaccuracy of parallel alignment of said charging member and said photoconductive member.

18. The method as defined in claim 13, wherein said providing step provides said charging member to partly form said gap having said tolerance.

19. An image forming apparatus, comprising:

a photoconductive member;

a charging apparatus for charging said photoconductive member, said charging apparatus comprising a charging member arranged to be adjacent to said photoconductive member to form a gap having a tolerance in a charging region relative to said photoconductive member, and applied with a direct current voltage under a constant voltage control including an alternating current element to apply a charge to said photoconductive member, said alternating current element having a peak-to-peak voltage at least twice as great as a charge-start voltage to be applied to said charging member at a maximum gap within a range of said gap having said tolerance, wherein the maximum gap is greater than a largest gap at which a charge-start voltage substantially equals a charge-start voltage required when said charging member substantially contacts the photoconductive member.

20. The image forming apparatus as defined in claim 19, wherein said charging member is a rotatable elastic roller.

21. The image forming apparatus as defined in claim 19, wherein said photoconductive member is a rotatable photoconductive drum or belt.

22. The image forming apparatus as defined in claim 19, wherein said tolerance of said gap is caused by an inaccurate flatness of a surface of said charging member.

23. The image forming apparatus as defined in claim 19, wherein said tolerance of said gap is caused by inaccuracy of parallel alignment of said charging member and said photoconductive member.

24. The image forming apparatus as defined in claim 19, wherein said charging member is arranged to be adjacent to and partly contact said photoconductive member so as to partly form said gap having said tolerance.

25. A charging apparatus, comprising:

a charging member arranged to be adjacent to a photoconductive member with a gap having a tolerance in a charging region relative to said photoconductive member, and applied with a voltage including a direct current voltage under a constant voltage control including an alternating current element under a constant current control to apply a charge to said photoconductive member, said alternating current element having a peak-to-peak voltage at least twice as great as a charge-start voltage to be applied to said charging member at a maximum gap within a range of said gap having said tolerance, wherein the maximum gap is greater than a largest gap at which a charge-start voltage substantially equals a charge-start voltage required when said charging member substantially contacts the photoconductive member.

26. The charging apparatus as defined in claim 25, wherein said charging member is a rotatable elastic roller.

27. The charging apparatus as defined in claim 25, wherein said photoconductive member is a rotatable photoconductive drum or belt.

28. The charging apparatus as defined in claim 25, wherein said tolerance of said gap is caused by an inaccurate flatness of a surface of said charging member.

29. The charging apparatus as defined in claim 25, wherein said tolerance of said gap is caused by inaccuracy of parallel alignment of said charging member and said photoconductive member.

30. The charging apparatus as defined in claim 25, wherein said charging member is arranged to be adjacent to and partly contact said photoconductive member so as to partly form said gap having said tolerance.

31. A charging apparatus, comprising:

charging means for charging a photoconductive member, said charging means forming a gap having a tolerance in a charging region relative to said photoconductive member, and applied with a voltage including a direct current voltage under a constant voltage control including an alternating current element under a constant current control to apply a charge to said photoconductive member, said alternating current element having a peak-to-peak voltage at least twice as great as a charge-start voltage to be applied to said charging means at a maximum gap within a range of said gap having said tolerance, wherein the maximum gap is greater than a largest gap at which a charge-start voltage substantially equals a charge-start voltage required when said charging means substantially contacts the photoconductive-member.

32. The charging apparatus as defined in claim 31, wherein said charging means is a rotatable elastic roller.

33. The charging apparatus as defined in claim 31, wherein said photoconductive member is a rotatable photoconductive drum or belt.

34. The charging apparatus as defined in claim 31, wherein said tolerance of said gap is caused by an inaccurate flatness of a surface of said charging means.

35. The charging apparatus as defined in claim 31, wherein said tolerance of said gap is caused by inaccuracy of parallel alignment of said charging means and said photoconductive member.

36. The charging apparatus as defined in claim 31, wherein said charging means is arranged to be adjacent to and partly contact said photoconductive member so as to partly form said gap having said tolerance .

37. A charging method, comprising:

providing a charging member to form a gap having a tolerance in a charging region relative to a photoconductive member;

superposing an alternating current element under a constant current control to a direct current voltage under a constant voltage control, said alternating current element having a peak-to-peak voltage at least twice as great as a charge-start voltage to be applied to said charging member at a maximum gap within a range of said gap having said tolerance; and applying said direct current voltage with said superposed alternating current element to said charging member to apply a charge to said photoconductive member, wherein the maximum gap is greater than a largest gap at which a charge-start voltage substantially equals a charge-start voltage required when said charging member substantially contacts the photoconductive member.

38. The method as defined in claim 37, wherein said charging member is a rotatable elastic roller.

39. The method as defined in claim 37, wherein said photoconductive member is a rotatable photoconductive drum or belt.

40. The method as defined in claim 37, wherein said tolerance of said gap is caused by an inaccurate flatness of a surface of said charging member.

41. The method as defined in claim 37, wherein said tolerance of said gap is caused by inaccuracy of parallel alignment of said charging member and said photoconductive member.

42. The method as defined in claim 37, wherein said providing step provides said charging member to partly form said gap having said tolerance.

43. An image forming apparatus, comprising:

a photoconductive member;

a charging apparatus for charging said photoconductive member, said charging apparatus comprising a charging member arranged to be adjacent to said photoconductive member to form a gap having a tolerance in a charging region relative to said photoconductive member, and applied with a direct current voltage under a constant voltage control including an alternating current element under a constant current control to apply a charge to said photoconductive member, said alternating current element having a peak-to-peak voltage at least twice as great as a charge-start voltage to be applied to said charging member at a maximum gap within a range of said gap having said tolerance, wherein the maximum gap is greater than a largest gap at which a charge-start voltage substantially equals a charge-start voltage required when said charging member substantially contacts the photoconductive member.

44. The image forming apparatus as defined in claim 43, wherein said charging member is a rotatable elastic roller.

45. The image forming apparatus as defined in claim 43, wherein said photoconductive member is a rotatable photoconductive drum or belt.

46. The image forming apparatus as defined in claim 43, wherein said tolerance of said gap is caused by an inaccurate flatness of a surface of said charging member.

47. The image forming apparatus as defined in claim 43, wherein said tolerance of said gap is caused by inaccuracy of parallel alignment of said charging member and said photoconductive member.

48. The image forming apparatus as defined in claim 43, wherein said charging member is arranged to be adjacent to and partly contact said photoconductive member so as to partly form said gap having said tolerance.

49. A charging apparatus, comprising:

a charging member arranged to be adjacent to a photoconductive member to form a gap having a tolerance in a charging region relative to said photoconductive member, and applied with a direct current voltage under a constant voltage control including an alternating current element to apply a charge to said photoconductive member, said gap having a mean value at each position in said charging region in longitudinal and circumference directions of said charging member is greater than 10 $\mu$m and of which deviation is greater than 10 $\mu$m relative to said mean value, said alternating current element having a peak-to-peak voltage at least twice as great as a charge-start voltage to be applied to said charging member at a maximum gap within a range of said gap having said tolerance.

50. The charging apparatus as defined in claim 49, wherein said charging member is a rotatable elastic roller.

51. The charging apparatus as defined in claim 49, wherein said photoconductive member is a rotatable photoconductive drum or belt.

52. The charging apparatus as defined in claim 49, wherein said gap is formed with an intermediate member to be placed between said charging member and said photoconductive member and a thickness of said intermediate member determines said maximum gap.

53. The charging apparatus as defined in claim 49, wherein said charging member is arranged to be adjacent to and partly contact said photoconductive member so as to partly form said gap having said tolerance.

54. A charging apparatus, comprising:

charging means for charging a photoconductive member, said charging means forming a gap having a tolerance in a charging region relative to said photoconductive member, and applied with a direct current voltage under a constant voltage control including an alternating current element to apply a charge to said photoconductive member, said gap having a mean value at each position in said charging region in longitudinal and circumference directions of said charging means is greater than 10 μm and of which deviation is greater than 10 μm relative to said mean value, said alternating current element having a peak-to-peak voltage at least twice as great as a charge-start voltage to be applied to said charging means at a maximum gap within a range of said gap having said tolerance.

55. The charging apparatus as defined in claim 54, wherein said charging means is a rotatable elastic roller.

56. The charging apparatus as defined in claim 54, wherein said photoconductive member is a rotatable photoconductive drum or belt.

57. The charging apparatus as defined in claim 54, wherein said gap is formed with intermediate means to be placed between said charging means and said photoconductive member and a thickness of said intermediate means determines said maximum gap.

58. The charging apparatus as defined in claim 54, wherein said charging means is arranged to be adjacent to and partly contact said photoconductive member so as to partly form said gap having said tolerance.

59. A charging method, comprising:

providing a charging member to form a gap having a tolerance in a charging region relative to said photoconductive member, said gap having a mean value at each position in said charging region in longitudinal and circumference directions of said charging member is greater than 10 μm and a deviation of said gap relative to said mean value is greater than 10 μm; and applying to said charging member a direct current voltage under a constant voltage control including an alternating current element to charge said photoconductive member, said alternating current element having a peak-to-peak voltage at least twice as great as a charge-start voltage to be applied to said charging member at a maximum gap within a range of said gap having said tolerance.

60. The method as defined in claim 59, wherein said charging member is a rotatable elastic roller.

61. The method as defined in claim 59, wherein said photoconductive member is a rotatable photoconductive drum or belt.

62. The method as defined in claim 59, wherein said gap is formed with an intermediate member to be placed between said charging member and said photoconductive member and a thickness of said intermediate member determines said maximum gap.

63. The method as defined in claim 59, wherein said charging member is arranged to be adjacent to and partly contact said photoconductive member so as to partly form said gap having said tolerance.

64. An image forming apparatus, comprising:

a photoconductive member;

a charging apparatus for charging said photoconductive member, said charging apparatus comprising a charging member arranged to be adjacent to said photoconductive member to form a gap having a tolerance in a charging region relative to said photoconductive member, and applied with a direct current voltage under a constant voltage control and an alternating current element to apply a charge to said photoconductive member, said gap having a mean value at each position in said charging region in longitudinal and circumference directions of said charging member is greater than 10 μm and of which deviation is greater than 10 μm relative to said mean value, said alternating current element having a peak-to-peak voltage at least twice as great as a charge-start voltage to be applied to said charging member at a maximum gap within a range of said gap having said tolerance.

65. The image forming apparatus as defined in claim 64, wherein said charging member is a rotatable elastic roller.

66. The image forming apparatus as defined in claim 64, wherein said photoconductive member is a rotatable photoconductive drum or belt.

67. The image forming apparatus as defined in claim 64, wherein said gap is formed with an intermediate member to be placed between said charging member and said photoconductive member and a thickness of said intermediate member determines said maximum gap.

68. The image forming apparatus as defined in claim 64, wherein said charging member is arranged to be adjacent to and partly contact said photoconductive member so as to partly form said gap having said tolerance.

69. A charging apparatus, comprising:

a charging member arranged to be adjacent to a photoconductive member to form a gap having a tolerance in a charging region relative to said photoconductive member, and applied with a direct current voltage under a constant voltage control including an alternating current element under a constant current control to apply a charge to said photoconductive member, said gap having a mean value at each position in said charging region in longitudinal and circumference directions of said charging member is greater than 10 μm and of which deviation is greater than 10 μm relative to said mean value.

70. The charging apparatus as defined in claim 69, wherein said charging member is a rotatable elastic roller.

71. The charging apparatus as defined in claim 69, wherein said photoconductive member is a rotatable photoconductive drum or belt.

72. The charging apparatus as defined in claim 69, wherein said charging member has a volume resistance ratio of $10^5$ Ωm or more.

73. The charging apparatus as defined in claim 69, wherein said charging member is arranged to be adjacent to and partly contact said photoconductive member so as to partly form said gap having said tolerance.

74. A charging apparatus, comprising:

charging means for charging a photoconductive member, said charging means forming a gap having a tolerance in a charging region relative to said photoconductive member, and applied with a direct current voltage under a constant voltage control including an alternating current element under a constant current control to apply a charge to said photoconductive member, said gap having a mean value at each position in said charging region in longitudinal and circumference directions of said charging means is greater than 10 μm and of which deviation is greater than 10 μm relative to said mean value.

75. The charging apparatus as defined in claim 74, wherein said charging means is a rotatable elastic roller.

76. The charging apparatus as defined in claim 74, wherein said photoconductive member is a rotatable photoconductive drum or belt.

77. The charging apparatus as defined in claim 74, wherein said charging means has a volume resistance ratio of $10^5$ Ωm or more.

78. The charging apparatus as defined in claim 74, wherein said charging means is arranged to be adjacent to and partly contact said photoconductive member so as to partly form said gap having said tolerance.

79. A charging method, comprising:

providing a charging member to form a gap having a tolerance in a charging region relative to said photoconductive member, said gap having a mean value at each position in said charging region in longitudinal and circumference directions of said charging member is greater than 10 $\mu$m and a deviation of said gap relative to said mean value is greater than 10 $\mu$m; and applying to said charging member a direct current voltage under a constant voltage control including an alternating current element under a constant current control to apply a charge to said photoconductive member, said alternating current element having a peak-to-peak voltage at least twice as great as a charge-start voltage to be applied to said charging member at a maximum gap within a range of said gap having said tolerance.

80. The method as defined in claim 79, wherein said charging member is a rotatable elastic roller.

81. The method as defined in claim 79, wherein said photoconductive member is a rotatable photoconductive drum or belt.

82. The method as defined in claim 79, wherein said charging member has a volume resistance ratio of $10^5$ Ωm or more.

83. The method as defined in claim 79, wherein said charging member is arranged to be adjacent to and partly contact said photoconductive member so as to partly form said gap having said tolerance.

84. An image forming apparatus, comprising:

a photoconductive member;

a charging apparatus for charging said photoconductive member, said charging apparatus comprising a charging member arranged to be adjacent to said photoconductive member to form a gap having a tolerance in a charging region relative to said photoconductive member, and applied with a direct current voltage under a constant voltage control and an alternating current element under a constant current control to apply a charge to said photoconductive member, said gap having a mean value at each position in said charging region in longitudinal and circumference directions of said charging member is greater than 10 $\mu$m and of which deviation is greater than 10 $\mu$m relative to said mean value.

85. The image forming apparatus as defined in claim 84, wherein said charging member is a rotatable elastic roller.

86. The image forming apparatus as defined in claim 84, wherein said photoconductive member is a rotatable photoconductive drum or belt.

87. The image forming apparatus as defined in claim 84, wherein said charging member has a volume resistance ratio of $10^5$ Ωm or more.

88. The image forming apparatus as defined in claim 84, wherein said charging member is arranged to be adjacent to and partly contact said photoconductive member so as to partly form said gap having said tolerance.

* * * * *